US009272252B2

(12) United States Patent
Bublewitz et al.

(10) Patent No.: US 9,272,252 B2
(45) Date of Patent: Mar. 1, 2016

(54) SYSTEM COMPOSED OF CARTRIDGES AND MIXERS

(75) Inventors: Alexander Bublewitz, Herborn (DE); Jens-Peter Reber, Meinerzhagen (DE)

(73) Assignee: Kettenbach GmbH & Co. KG, Eschenburg (DE)

( * ) Notice: Subject to any disclaimer, the term of this patent is extended or adjusted under 35 U.S.C. 154(b) by 0 days.

(21) Appl. No.: 14/240,293

(22) PCT Filed: Aug. 10, 2012

(86) PCT No.: PCT/EP2012/065688
§ 371 (c)(1), (2), (4) Date: Feb. 21, 2014

(87) PCT Pub. No.: WO2013/026716
PCT Pub. Date: Feb. 28, 2013

(65) Prior Publication Data
US 2014/0197204 A1 Jul. 17, 2014

(30) Foreign Application Priority Data
Aug. 24, 2011 (DE) ..... 10 2011 111 046
Jul. 6, 2012 (DE) ..... 10 2012 106 094

(51) Int. Cl.
*B67D 7/78* (2010.01)
*B01F 13/00* (2006.01)
(Continued)

(52) U.S. Cl.
CPC ..... *B01F 13/0023* (2013.01); *B05C 17/00513* (2013.01); *B05C 17/00553* (2013.01);
(Continued)

(58) Field of Classification Search
CPC ..... B05C 17/005; B05C 17/00506; B05C 17/00513; B05C 17/00553; B05C 17/00566; B05C 17/00596; B05C 17/00509; B65D 81/32; B65D 81/325; B01F 13/0023; B01F 2215/0039
USPC ..... 222/145.5–145.6, 566–567, 137
See application file for complete search history.

(56) References Cited

U.S. PATENT DOCUMENTS 4,981,241 A * 1/1991 Keller ..... 222/137
5,413,253 A * 5/1995 Simmen ..... 222/137
(Continued)

FOREIGN PATENT DOCUMENTS

DE 202006004738 U1 6/2006
EP 0600138 B1 6/1994
(Continued)

OTHER PUBLICATIONS

Form PCT/IB/338, Notification of Transmittal of Translation of the International Preliminary Report on Patentability, dated Feb. 27, 2014.

*Primary Examiner* — Frederick C Nicolas
(74) *Attorney, Agent, or Firm* — McDonnell Boehnen Hulbert & Berghoff LLP

(57) ABSTRACT

A system of several different types of cartridges and several different types of mixers that can be connected with one another. As double cartridges, the cartridges have two containers that are connected with each other. Each container is associated with an outlet opening or outlet connector. The mixers have two inlet openings or inlet connectors respectively that can be coupled to the outlet openings or outlet connectors. The size of the inlet openings or inlet connectors and the size of the outlet openings or outlet connectors is the same for each type of mixer and/or each type of cartridge. For associating a type of mixer with a type of cartridge, guide protrusions are provided at the mixers or corresponding openings at the cartridges.

19 Claims, 5 Drawing Sheets

(51) Int. Cl.
*B65D 81/32* (2006.01)
*B05C 17/005* (2006.01)

(52) U.S. Cl.
CPC ... *B05C17/00596* (2013.01); *B01F 2215/0039* (2013.01); *B05C 17/00506* (2013.01); *B05C 17/00509* (2013.01); *B05C 17/00566* (2013.01); *B65D 81/325* (2013.01)

(56) References Cited

U.S. PATENT DOCUMENTS 5,458,262 A * 10/1995 Keller ..... 222/135
5,918,772 A * 7/1999 Keller et al. ..... 222/145.6
7,316,330 B2 1/2008 Muller et al.
2010/0102088 A1 4/2010 Keller
2010/0200614 A1 * 8/2010 Von Rotz et al. ..... 222/145.5
2010/0208544 A1 8/2010 Wintergerste et al.

FOREIGN PATENT DOCUMENTS

EP 1943012 B1 7/2008
WO 2004009249 A1 1/2004
WO 2009033832 A1 3/2009

* cited by examiner

SYSTEM COMPOSED OF CARTRIDGES AND MIXERS

CROSS REFERENCE TO RELATED APPLICATIONS

The present application is a 35 U.S.C. 371 National Application of PCT/EP2012/065688 filed Aug. 10, 2012, which claims priority to German Patent Application No. 10 2011 111 046.5, filed Aug. 24, 2011, and National Application No. PCT/EP2011/068784, filed Oct. 26, 2011, and German Patent Application No. 10 2012 106 094.0, filed Jul. 6, 2012 the entire contents of which are incorporated entirely herein by reference.

The invention relates to a system consisting of several different types of similar cartridges and several different types of similar mixers that can be connected with such. Thereby, the cartridges are preferably designed as double cartridges having two containers that are connected with each other respectively having an outlet opening or an outlet connector. Thereby, the containers can be positioned behind each other, next to each other (for example, parallel) or stacked (tube-in-tube). The mixers are respectively provided with two inlet openings or inlet connectors that can be coupled to the outlet openings or outlet connectors of the cartridges. Thereby, the system includes at least two types of cartridges that have a different volume ratio of their containers.

Similar cartridges are cartridges that have an identical total volume regardless of the volume ratios of their containers. Frequently, similar cartridges can be used with the same delivery device. In the dental area it is customary, for example, to empty so-called large cartridges with a total fill amount of both containers combined of 380 ml, by means of a motor-driven delivery device. Such large cartridges are available in different types, for example, directly filled cartridges and cartridges filled with pouches, or cartridges in which the volume ratio or the cross sectional ratio of the containers varies. But all of these large cartridges are understood to be similar when they have the same total volume. Further, smaller cartridges with a total fill amount of, for example, 50 ml are also available, which can frequently be emptied using a manual pistol. These smaller cartridges are also considered to be similar, regardless of whether the volume ratio or cross sectional ratio of the containers is, for example, 1:1, 2:1, 4:1 or 10:1, to the extent they have the same total volume. With respect to the delivery devices, these smaller cartridges by volume are different to the extent that cartridges with a volume ratio or a cross sectional ratio of the containers of 1:1 and 2:1 can be actuated with a pistol, while cartridges with a volume ratio or a cross sectional ratio of the containers of 4:1 and 10:1 are actuated with a slightly different pistol with respect to the plunger distance.

Mixers are differentiated in the same way, for example, a distinction is made between dynamic mixers with a drivable mixing element, and static mixers with a mixing coil that is not driven. Dynamic mixers that are frequently used with large cartridges are thereby considered to be similar mixers, even though the cross sections of the mixing tubes can vary, or some dynamic mixers have a delay or reservoir chamber, while others do not. Static mixers that are frequently used with the smaller 50 ml cartridges are thereby also considered to be similar mixers regardless of the differences in length or cross section of the respective mixing tube, or regardless of the presence of a delay or reservoir chamber in the inlet section of the mixer, or regardless of the number of mixing elements.

A double cartridge with two containers and a mixing ratio by volume of its containers that is different from 1:1, and a suitable dynamic mixer are known from EP 1 943 012 B1. The mixer can be connected with the double cartridge by inserting an inlet connector of the mixer into the outlet connector of one container of the double cartridge, while the second inlet connector of the mixer is placed on an outlet connector of the smaller container of the double cartridge.

The diameters of the inlet and outlet connectors are of a different size corresponding to the volume ratio of the containers. In order to be able to place the mixers onto the double cartridge in the proper alignment, a coding nose is provided on the mixer that engages with a corresponding recess in the cartridge when the mixer is placed on the double cartridge properly aligned with the double cartridge, i.e. in such a way that the larger inlet connector of the mixer and the larger outlet connector of the cartridge, as well as the smaller inlet connector of the mixer and the smaller outlet connector of the cartridge can engage.

Furthermore, from EP 0 600 138 B1, a cartridge with a pertaining mixer is known, whereby at least one border is provided at the mixer that can be brought to engage with a corresponding groove at the neck of the cartridge connection. Alternatively, the mixer can receive a notch that serves to house a tappet at the cartridge connection. The storage cylinders known from the cartridge of EP 0 600 138 B1 can either have the same or different volumes or cross sections/geometries.

In known systems it is most often customary that each cartridge with a different volume ratio of the containers is individually associated with a mixer that is suitable for the cartridge with respect to the cross sections of the inlet and outlet openings. Sometimes, it is also possible to place a mixer onto two different cartridges with different volume ratios, whereby the correct association of the mixer suitable for a cartridge is frequently accomplished by a color marking at the cartridge and the mixer. Thus, for example, for a 50 ml 1:1 cartridge, there are several mixers with different lengths, diameters and mixing elements, the coding nose of which is identical, is positioned at the same position and has identical cross sections of the inlet channels and thus all fit onto a cartridge. On the other hand, for this 50 ml 1:1 cartridge, dental materials that are of different types (viscosity, material and kinetics) can therefore only be delivered and homogeneously mixed with a certain type of mixer (delivery force). According to prior art, this is ensured only by a color coding of the locking stopper on the cartridge in the delivery state, and by the corresponding mixers with the same color coding that have been released by dental manufactures. However, after several uses of the cartridge, another mixer that has not been released can inadvertently be placed on the cartridge, which can lead to bad mixing results and ultimately to an unsatisfactory result for the patient.

In contrast, it is the objective of the present invention to provide a system consisting of several cartridges and mixers that can be produced at a reduced manufacturing expense and simultaneously makes a defined association of a mixer that fits a cartridge possible.

According to the invention, this problem is solved by the features of Claim 1. Thereby, the invention is based on the idea that the size of the inlet openings or inlet connectors for each mixer type, and the size of the outlet openings or outlet connectors for each cartridge type are the same. As a result of the identical design of the inlet openings or inlet connectors and the outlet openings or outlet connectors, the interface between cartridge and mixer can be designed to be largely identical, as a result of which only minimal modifications of the manufacturing tools are required. Further, according to the invention it is provided that for the association of at least one mixer type with at least one cartridge type, each mixer type is equipped with a different cross section than other mixer types, has a guide protrusion projecting in axial direction of the mixer and that each type of cartridge is provided with an opening that has a different cross section from other types of cartridges for housing a guide protrusion of the mixer. As a result of the corresponding design of the cross sections of the guide protrusions and openings, it can be specifically defined according to the key/lock principle as to which mixer can be connected with which cartridge. In this way, mix-ups or using an unsuitable mixer with a cartridge is precluded.

The guide protrusion of the mixer that is provided according to the invention with the correspondingly designed opening of the cartridge thereby, in addition to the coding function known, for example, from EP 0 600 138 B1 or EP 1 943 012 B1 for aligning the mixer relative to the cartridge meets the function that only certain types of mixers with certain types of cartridges can be connected, even though the inlet openings or inlet connectors of the mixers and the outlet openings or outlet connectors of the cartridges would, as it were, permit a connection of any mixer type with any cartridge type. In other words, relative to the design of the interface between the cartridge and the mixer only the cross sections of the guide protrusions and the corresponding openings need to be modified so that a significantly lower manufacturing cost is incurred than in the respectively individual design of the interface for each type of mixer and each type of cartridge. In other words, the cross section ratios of containers that is customary for smaller 50 ml cartridges of, for example, 1:1, 1:2, 1:4, 1:10, can all be designed with an identical interface except for the cross section of the respective guide protrusions.

In the following, the present invention will be described by referring to the exemplary embodiment, according to which a guide protrusion is provided at the mixer, while the cartridge is provided with a correspondingly shaped opening for receiving the guide protrusion. Deviating from this, according to the invention additionally or as an alternative, a guide protrusion can be provided at the cartridge that engages with a correspondingly shaped opening of the mixer. The inlet openings or inlet connectors and the outlet openings or outlet connectors are thereby not viewed as guide protrusion or openings according to the invention. Rather, the guide protrusion is an additionally provided feature on the mixer or the cartridge.

For mounting a mixer to a cartridge, in addition to mere placement, coupling brackets, connecting nuts and bayonet closures are known. In contrast, in a system according to the present invention it is preferred when for mounting a mixer onto a cartridge, each cartridge type has an inner thread and each mixer type has an outer thread. The outer thread of each mixer type can thereby be screwed into the respective inner thread of each cartridge type. In other words, in addition to the interface for connecting the inlet openings or inlet connectors and the outlet openings or outlet connectors, the interface for attaching the mixer to the cartridge is essentially also identical in construction for all mixers and cartridges of the system. Thereby, it is especially preferred when at the cartridge, a ring surrounding the outlet openings or outlet connectors is provided that has an inner thread, while the mixer has a mixer housing that is respectively provided with an outer thread, which is freely rotatable relative to a cover or insert which has the inlet openings or inlet connectors of the mixer.

Preferably, each cartridge type can be connected with precisely one type of mixer and/or each mixer type can be connected only with one type of cartridge. In the former case, one mixer can be used, for example, for two different types of cartridges. In the latter case, for example, two different mixers can be placed on the same cartridge type. It is also possible according to the invention that the mixer and the cartridges are designed in such a way that a use of a mixer on a different cartridge type, or a cartridge with a different mixer type is precluded. Thus, it is also possible to associate precisely one mixer with precisely one cartridge.

The design of the inlet openings or inlet connectors according to the invention and of the outlet openings or outlet connectors having the same construction for all mixer types and for all cartridge types has the effect that the cross sections of the inlet openings or inlet connectors and the outlet openings or outlet connectors are adapted to the maximum volume penetration that is to be expected in the system. In particular, for volume ratios of the containers of the cartridge that are very different from 1:1, this can be perceived as being disadvantageous, as the flow resistance of the components is hereby very different. Especially in this case, it is preferred when in at least one outlet opening or at least one outlet connector of the cartridge, an element is provided that decreases the lumen. This can be, for example, an insert or an element that is formed integral with the cartridge, which decreases the cross section of the outlet opening or the outlet connector and/or functions as a restriction. This element that reduces the lumen is preferably located in such a way that it is provided outside of the actual contact area between mixer and cartridge, so that the placement of the mixer onto the cartridge is not affected thereby.

The guide protrusions of the mixer and/or the openings of the cartridges can be annular or polygonal in cross section according to a preferred embodiment. Alternatively or additionally, the guide protrusions of various types of mixers and/or the openings of various types of cartridges can be designed different in cross section and/or have differently positioned protrusions and/or recesses. Different from the previously cited examples, different designs of the cross sections of the guide protrusions or the openings are also possible to the extent an association of a certain mixer with a certain cartridge is thereby made possible.

The system according to the invention can have so-called dynamic mixers, i.e. mixers with a rotating drivable mixing element, or static mixers with a mixing element that is not drivable. It is also possible in principle, that the system according to the invention has dynamic mixers as well as static mixers. In addition to the differentiation between dynamic and static mixers, two types of mixers of the system can also be different thereby, that the mixing area provided in each mixer has a different diameter in different types of mixers. In this way, different viscosities of the materials that are to be processed can be accommodated, for example.

The mixers of the system according to the invention are preferably designed in such a way that their guide protrusions are at a distance from the inlet opening or inlet connectors, and at a distance from the outer thread. Neither the thread nor the attachment means nor the inlet openings or inlet connectors for connecting the mixer to the cartridge are thus suitable as means for associating a mixer with a cartridge type. Preferably, the respective guide protrusion is longer for this than the connectors, and is active prior to the engagement of the threads.

Regardless of the previously described features, in a connection between a mixer and a cartridge by means of a threaded connection it is advantageous when catch elements are respectively provided at the mixers and at the cartridges that detachably engage with each other when the thread of the mixer is screwed completely into the thread of a cartridge. In this way, an unintentional separation of the mixer from the cartridge is avoided. Simultaneously, a user receives a tactile and/or acoustic confirmation that the mixer is properly attached to the cartridge.

When a separating wall is provided between the inlet openings or inlet connectors of the mixer, it can additionally prevent that the mixer comes in contact with the cartridge in the event the mixer is positioned incorrectly (e.g. tilted). This avoids any carryover of material and cross contamination.

The separating wall and the guide protrusion of the mixer preferably protrude in axial direction over the inlet openings or inlet connectors so that these two elements additionally prevent that the inlet openings or inlet connectors of the mixer come in contact with the outlet openings or outlet connectors of the cartridge when improperly aligned. Thereby, the guide protrusion, as described above, can be provided with a (mechanical) coding, i.e. with a contour that is adapted to the contour of an opening of the cartridge in such a way that the mixer can only be connected with the cartridge in a specific alignment.

Preferably, the outlet openings or outlet connectors of the cartridge can be closed with a removable locking stopper. In the delivery state of the cartridge, the locking stopper can be connected with it and is then removed prior to the first use of the cartridge.

As the interface for connecting a mixer is essentially designed identical for similar cartridges, the outlet openings or outlet connectors of similar cartridges can be respectively locked with identical (identical construction) locking stoppers.

Hereby, even with respect to the locking stoppers, uniformity is achieved and thus cost savings.

According to a preferred embodiment, the locking stopper has two connectors that can be inserted into the outlet openings or outlet connectors of the cartridges and at least one catch element that can snap into the cartridges, which is connected with the connectors by an elastically deflectable torsion element in such a way that the connectors can be elastically twisted relative to the at least one catch element. The catch element is thereby preferably connectable with the inner thread of the cartridge and, in particular, is designed as a hook that engages behind the end of the thread in the direction of the circumference. The torsion element makes it possible that the part of the locking stopper that is provided with the at least one catch element is rotated relative to the part of the locking stopper that has the connector, in order to release the snap-lock.

According to an especially preferred embodiment, the engagement hook itself is supported—and/or at least a bar provided in the direction of the circumference adjacent to the engagement hook—by a thread of the cartridge in such a way that the locking stopper, upon a rotation of the at least one catch element, is lifted off the cartridge.

In the following, the invention is described in more detail with the aid of exemplary embodiments and by referring to the drawing. Thereby, the described and/or illustrated features by themselves form the subject matter of the invention regardless of their summary in the claims or their reference.

BRIEF DESCRIPTION OF THE DRAWINGS

Schematically shown are:

FIGS. 1*a* and 1*b* respectively show a double cartridge 1*a* or 1*b*, that consists of two connected containers 2, 3 and a connection section 4. A comparison of FIGS. 1*a* and 1*b* shows that containers 2, 3 can have different cross sections and thereby, can have different volumes at the same length. Thus, the ratio of volumes of the two containers 2 and 3 in the embodiment according to FIG. 1*a* is, for example, 10:1, while the volume ratio of the containers in FIG. 1*b* is 1:1, whereby the total volume of cartridges 1*a* or 1*b* is identical (e.g. 50 ml). Cartridges 1*a* and 1*b* are thus considered to be two different types of similar cartridges.

Figure 1A:
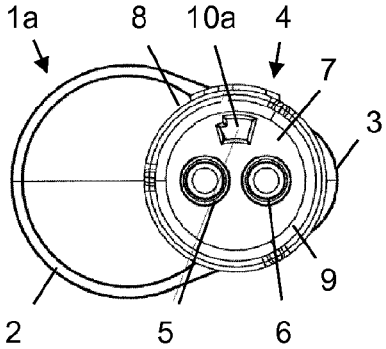
FIG. 1*a* shows a lateral view of a cartridge of the system according to the invention.
Figure 1C:
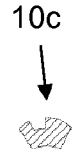
FIG. 1*c* shows the contour of an opening for a further cartridge of the system according to the invention.
Figure 1D:
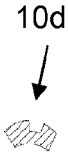
FIG. 1*d* shows the contour of a further opening of a cartridge of the system according to the invention.
Figure 1B:
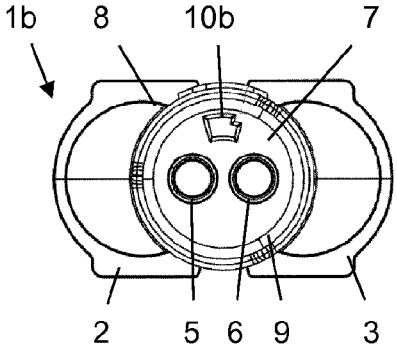
FIG. 1*b* shows a lateral view of a further cartridge of the system according to the invention.

Connection section 4 of the cartridges has an outlet connector 5 or 6 for each container 2 or 3 respectively. Outlet connectors 5, 6 can protrude from a circular plate 7 in the illustrated exemplary embodiment, and are additionally surrounded by a ring 8 that is provided with an inner thread 9. Further, a through hole is formed in plate 7, whereby opening 10*a* in FIG. 1*a* has a slightly different cross section than opening 100*b* in FIG. 1*b*. In the illustrated embodiment, both openings 10*a*, 10*b* are respectively designed approximately like a ring segment and have a protrusion at different positions projecting into the opening. Further examples for the cross section of openings of this type are shown in FIGS. 1*c* and 1*d*, whereby these differentiate themselves by the position of the protrusion within the ring-segment-like opening.

Figure 2B:
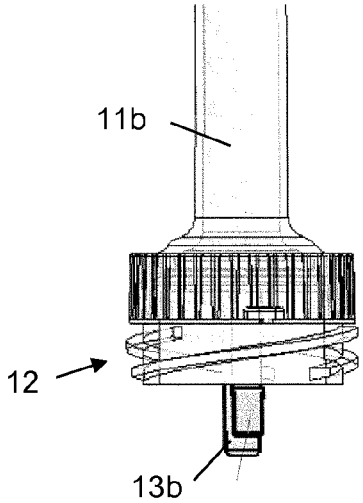
FIG. 2*b* shows a mixer that can be connected with a cartridge according to FIG. 1*b*.
Figure 2A:
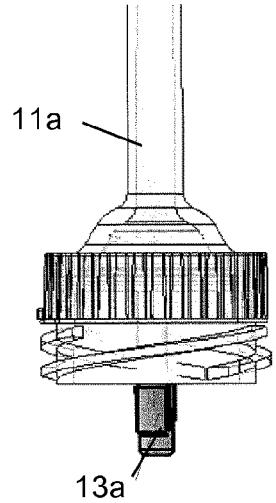
FIG. 2*a* shows a mixer that can be connected with a cartridge according to FIG. 1*a*.
Figure 2C:
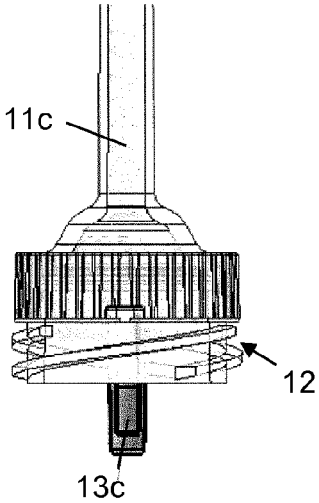
FIG. 2*c* shows a mixer that can be connected with the cartridge according to FIG. 1*a* or the cartridge according to FIG. 1*b*.

FIGS. 2*a* through 2*c* respectively show different types of similar static mixers 11*a*, 11*b*, 11*c* having a housing and an insert rotatable relative to the housing. The housing that respectively defines a mixing area can be designed with different cross sections. On the outside of the housings, an outer thread 12 is provided respectively, which can be screwed into the inner thread 9 of the cartridges. The insert of the mixers respectively has inlet connectors that can be inserted into outlet connectors 5, 6 of the cartridges. Just like outlet connectors 5, 6 of the cartridges—regardless of the volume ratio of the containers—have the same cross section, inlet connectors of mixers 11*a*, 11*b*, 11 likewise have the same cross section.

Additionally, at the insert, a guide protrusion 13*a*, 13*b*, 13*c* is provided that extends parallel to the inlet connectors in the direction toward the cartridge. The guide protrusion thereby has a cross section that is adapted to the cross section of the openings in connection section 4 of the cartridges. Thus, the cross section of guide protrusion 13*a* is selected in such a way that it can be inserted into opening 10*a* of cartridge 1*a*, but not into opening 100*b* of cartridge 1*b*. In the same way, guide protrusion 13*b* of mixer 11*b* is designed in such a way that it can be inserted into opening 10*b* of cartridge 1*b*, but not into opening 10*a* of cartridge 1*a*. Guide protrusion 13*c* of mixer 11*c*, on the other hand, is designed in such a way that it can be inserted into opening 10*a* of cartridge 1*a*, as well as into opening 100*b* of cartridge 1*b*. Guide protrusions 13*a* and 13*b* are thus comparable with an individual key, and guide protrusion 13*c* with a master key.

Figure 3A:
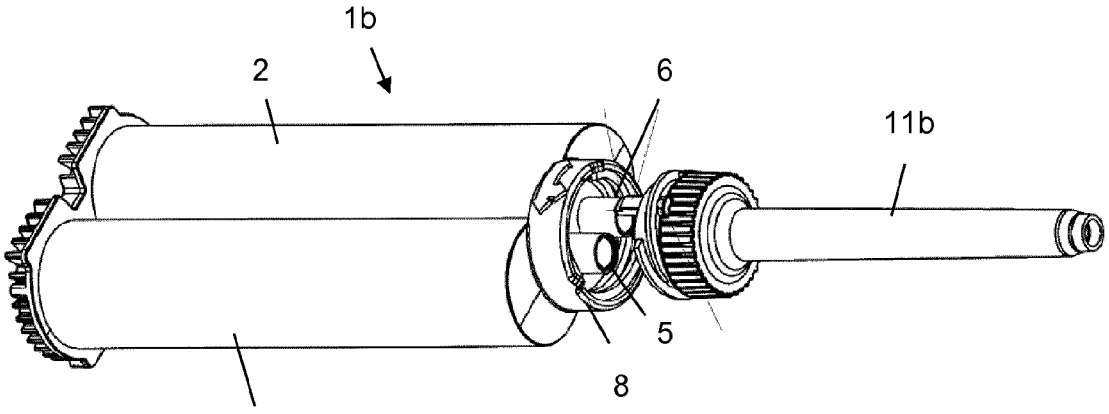
FIG. 3*a* shows a lateral view of the mixer according to FIG. 2*b* with the cartridge according to FIG. 1*b*.
Figure 3B:
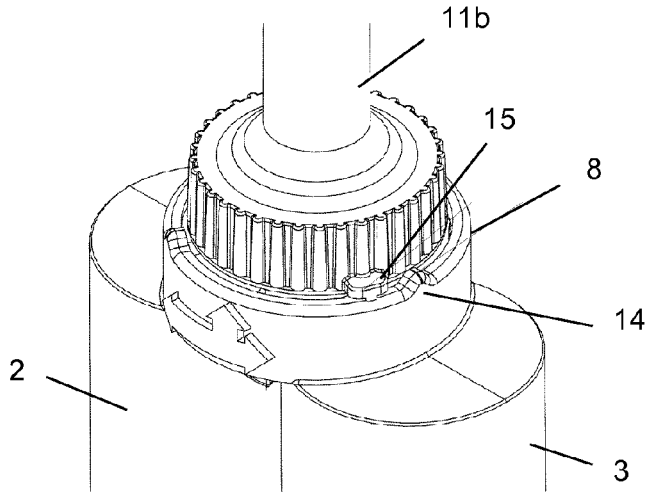
FIG. 3*b* shows a cut-out of the connected mixer according to FIG. 2*b* with the cartridge according to FIG. 1*b*.

A further detail of the mixers or cartridges can be seen in FIGS. 3*a* and 3*b*. Thus, at ring 8 of the cartridges, several tappets 14 are provided on the front facing the mixer, while on the mixer, respectively at the housing, counter tappets 15 are provided. Tappets 14 and counter tappets 15 are thereby located in such a way that a counter tappet 15 snaps into a tappet 14, when the mixer is completely screwed into inner thread 9 of a cartridge with its outer thread 12.

Figure 4A:
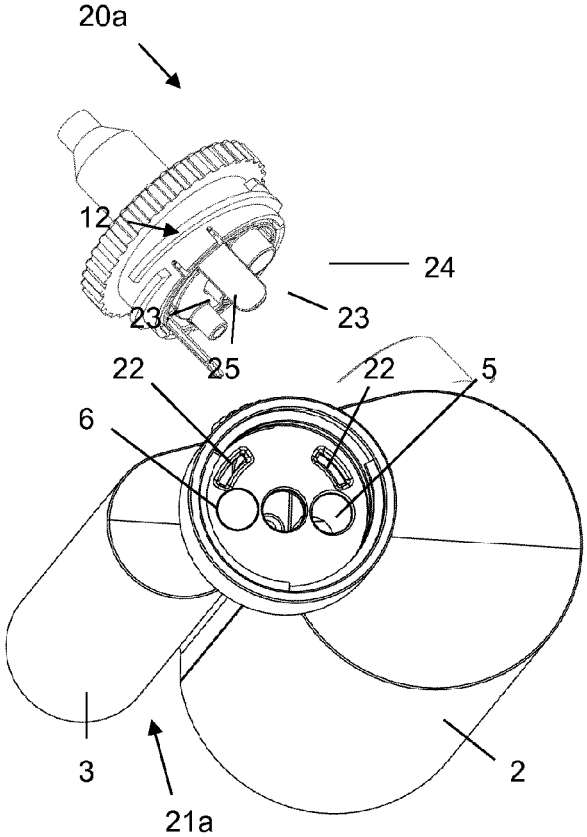
FIG. 4*a* shows a mixer and a cartridge according to a further system according to the invention.

FIG. 4*a* shows a dynamic mixer 20*a* with a cartridge 21*a* that is suitable for it. The design of cartridge 21*a* thereby corresponds essentially to the previously described cartridges 1*a* and 1*b*, whereby the connection section 4 of cartridge 21*a* is designed in such a way that instead of outlet connectors 5, 6 projecting over plate 7, only outlet openings 5, 6 are provided. Beyond that, between outlet openings 5, 6, a through hole is provided through which a drive shaft can be passed for driving the rotation of the mixing element of mixer 20*a*. Further, instead of the individual openings in plate 7, in FIG. 4*a*, ring-segment-like openings 22 are formed respectively.

Correspondingly, mixer 20*a* is also provided with two, in cross section ring-segment-like guide protrusions 23, which extend parallel to inlet connectors 24 or 25. The fastening of mixer 20*a* to cartridge 21*a* is accomplished as described previously by first inserting guide protrusions 23 into corresponding openings 22 of cartridge 21*a*. As a result of screwing outer thread 12 of the mixer housing into inner thread 9 of ring 8 of cartridge 21*a*, mixer 20*a* is connected with cartridge 21*a*, whereby inlet connectors 24, 25 of mixer 20*a* also engage with outlet openings 5 or 6 of cartridge 21*a*.

Figure 4B:
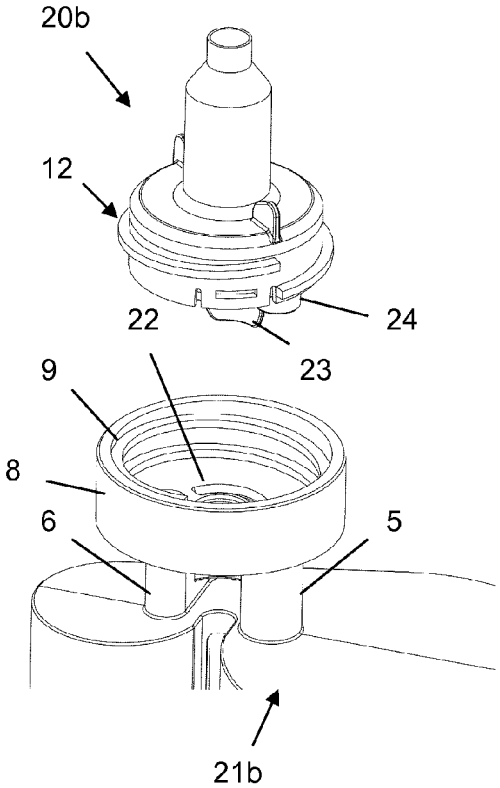
FIG. 4*b* shows a different mixer and a different cartridge of the system according to FIG. 4*a*.

In the embodiment according to FIG. 4*b*, instead of the two guide protrusions 23, only a single guide protrusion that is ring-segment-like in cross section is provided at mixer 20*b*. Correspondingly, cartridge 21*b* also has only one ring-segment-like opening 22. Mixer 20*b* can thus only be connected with cartridge 21*b*, but not with cartridge 21*a*. In the same way, mixer 20*a* can only be connected with cartridge 21*a*, but not with cartridge 21*b*.

Figure 5:
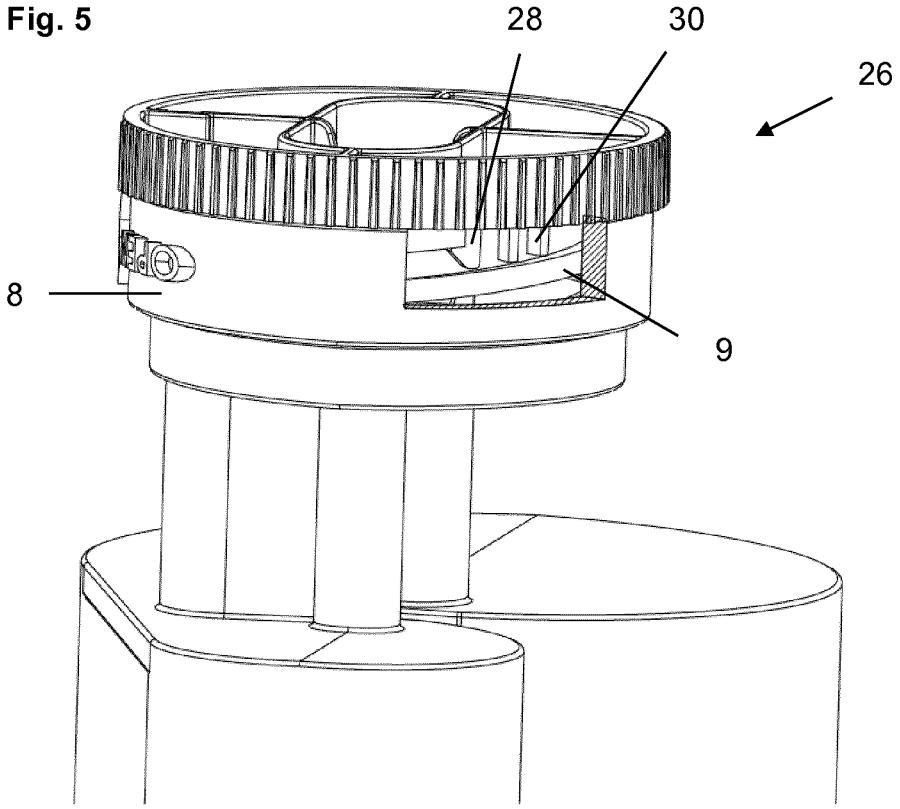
FIG. 5 shows a partial cross section of a cartridge with a locking stopper.
Figure 6:
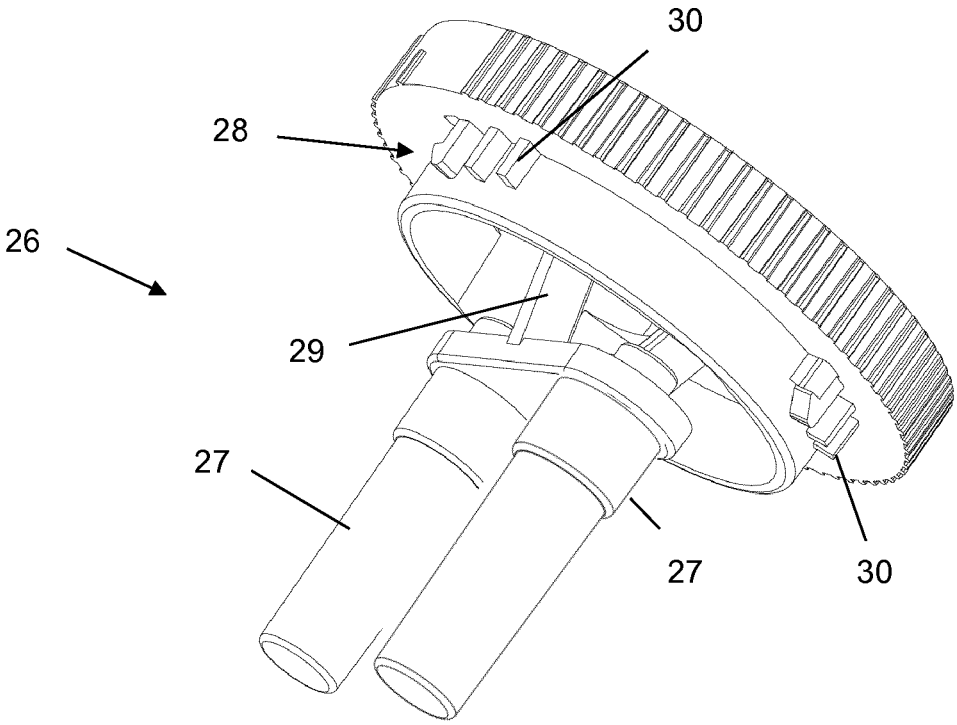
FIG. 6 shows a locking stopper according to FIG. 5 in a perspective view.

FIGS. 5 and 6 show a locking stopper 26 with two connectors 27 that can be inserted into the outlet openings or outlet connectors 5, 6 of a cartridge, as well as at least one catch element 28 that can be snapped into the cartridges. Catch element 28 is shaped like an engagement hook that is connected with connectors 27 by a torsion element 29 that can be overcome elastically in such a way that connectors 27 can be rotated elastically relative to catch element 28. FIG. 5 shows that catch element 28 can be connected with inner thread 9 of the cartridge when the hook engages behind the end of the thread in the direction of the circumference. Torsion element 29 makes it possible that the ring-like part of the locking stopper that is provided with at least one catch element, is rotated relative to the part of the locking stopper that is provided with connector 27, in order to release the snap-on connection.

In FIG. 5 it can further be seen that engagement hook 28 and two bars that are provided in the direction of the circumference adjacent to the engagement hooks are supported by a thread of the cartridge. This has the effect that locking stopper 26 is lifted off the cartridge upon a rotation of the annular part with catch element 28, so that connector 27 is pulled out of the outlet openings or outlet connectors 5, 6 of the cartridge.

Figure 7:
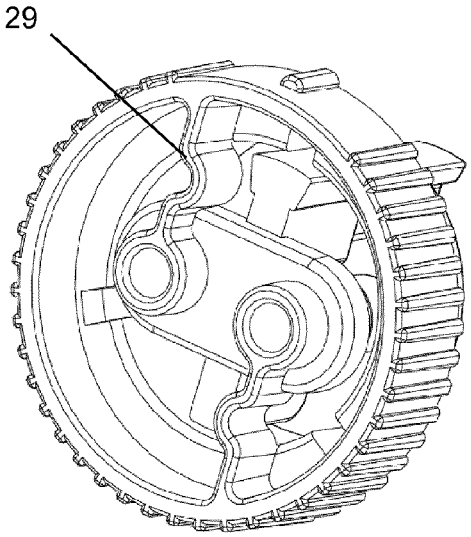
FIG. 7 shows a one-piece locking element.
Figure 8:
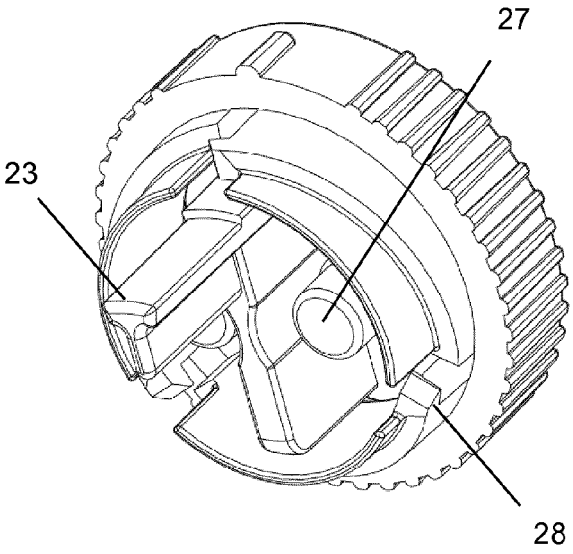
FIG. 8 shows the locking element according to FIG. 7 in a perspective view.

Regardless of the previously described features of the mixer and/or the cartridge, the invention also relates to a one-piece locking element that is shown in FIGS. 7 and 8, which can be placed onto a cartridge instead of the mixer. To lock the cartridge, two stoppers 27 or connectors are provided that can be inserted into outlet connectors 5 or 6 to seal them. Stoppers 27 are respectively connected to a sleeve by a bar 29, that acts like a torsion spring, which can be inserted into the collar of the outlet end of the cartridge. An expanded edge of the sleeve that has a knurling rests on the front of the collar, when the locking element has been placed onto the cartridge to seal it.

The locking element can be secured in the collar (ring 8) by means of engagement hooks 28 that engage behind the threaded segments of inner thread 9 and thus interlock the locking element on the cartridge. To release the locking element, the sleeve with the knurling can be slightly rotated, whereby bar 29 deflects, as stoppers 27 at first continue to be stuck in outlet connectors 5 or 6. This deflection of bar 27 that acts as torsion element makes it possible that engagement hooks 27 can be disengaged from the threaded segments of inner thread 9, so that the locking element can be removed from the cartridge.

The locking stopper has a positioning latch (or a guide protrusion 23) that can be designed in such a way that after it is passed through a corresponding opening in the cartridge, is becomes visible to the user on the outside. This has the advantage of a visual control as to whether the locking stopper and/or the positioning latch has been inserted properly. The torsion element of the locking stopper can, as shown in FIG. 7, have a radial S-shape in order to secure a corresponding rotation path even in the case of locking stoppers with small diameters. The locking stopper shown in FIGS. 7 and 8 is also a single piece which offers the advantage of simpler production of the locking stopper in contrast to known multipart locks.

Figure 9:
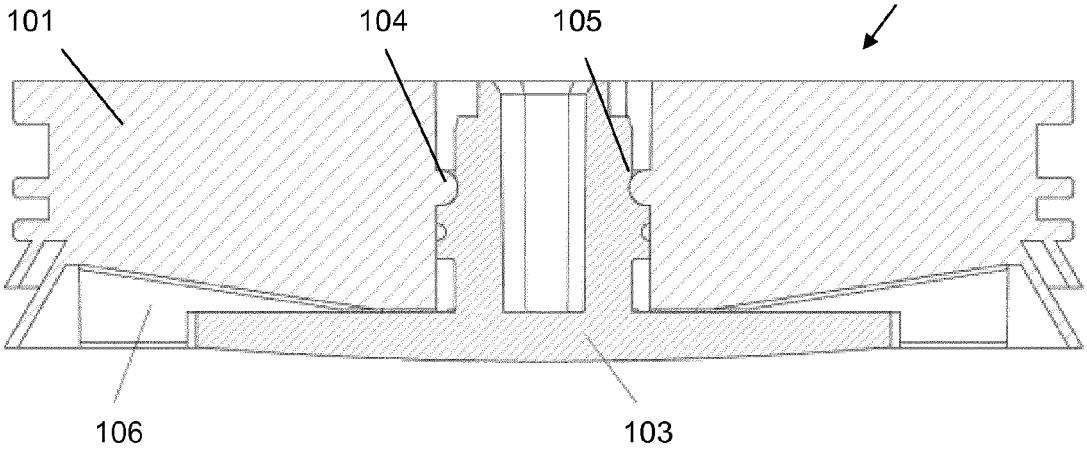
FIG. 9 shows a delivery plunger with screw cap in cross section.
Figure 10:
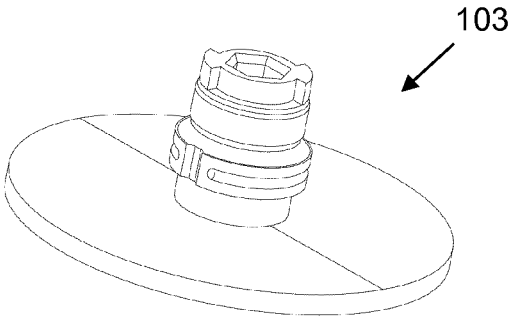
FIG. 10 shows the screw cap according to FIG. 9 in a perspective view.
Figure 11:
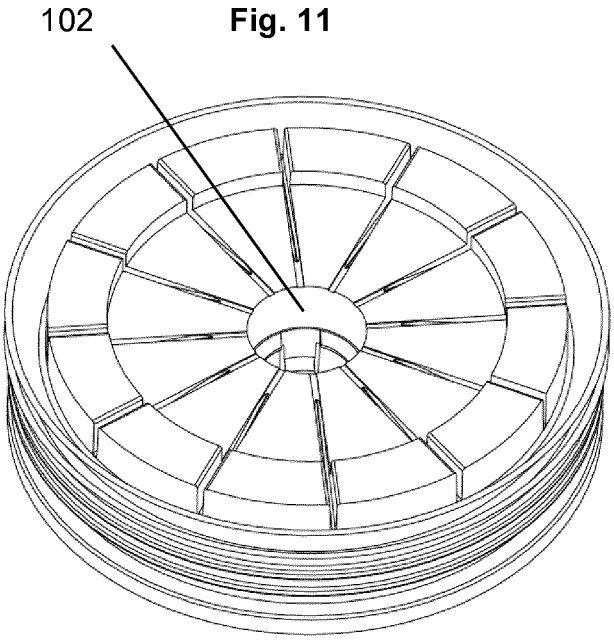
FIG. 11 shows the delivery plunger according to FIG. 9 in a perspective view.

In FIG. 9 through 11, a delivery plunger with screw cap is shown that can be used in a cartridge system according to the invention for delivering components out of the containers. The plunger is hereby provided with a vent that makes it possible for air to escape from the respective container when the container is filled with the component and the delivery plunger is used. As some substances have a tendency to react with the residual air remaining in the cartridge after the cartridge has been filled, it is the goal to let as much of the residual air as possible escape. Possibly remaining residual air in the container between the plunger and the substance in the cartridge is also considered to be a disadvantage because the residual air forms a compressible pillow, which makes the dosing precision when delivering the substance out of the cartridge more difficult.

Plunger 100 that is shown in FIG. 9 through 11 has a base body 101 that has a lateral wall provided with sealing means and a front wall that is provided with a vent 102. This vent 102 extends through the entire base body so that an air exchange between the side of the front wall (in feed direction) and the rear side of plunger 100 is possible. Thereby, a locking element 103 is mounted rotatable in vent 102, whereby as a result of a relative rotation of locking element 103 in vent 102, a ventilation channel can be opened or closed. In other words, it is possible to establish or stop the flow connection between the side of plunger 100 in feed direction and the rear side of the plunger, by rotating locking element 103.

For this, on the inner surface of vent 102, a surrounding protrusion 104 is formed that engages with a corresponding groove 105 in locking element 103 in order to interlock them. Protrusion 104 as well as groove 105 are provided with through holes respectively that can be brought into alignment in order to release a ventilation channel, or brought out of alignment in order to close the ventilation channel. The through hole thereby extends through perpendicular groove 105 that can be slightly deeper than the through hole so that protrusion 104 can securely lock the through hole.

To optimize the imperviousness of the plungers with screw cap (discharge of impression mass out of the closed ventilation valve under delivery conditions), the star-shaped ventilation slots 106 are designed conically tapered so that the total cross section surface is reduced to a fraction, for example, to 1/100 of the original cross section surface. In this way, the trapped air can continue to escape unimpeded upon locking the cartridge, but an entry of impression material into the ventilation valve is severely impeded.

Figure 12:
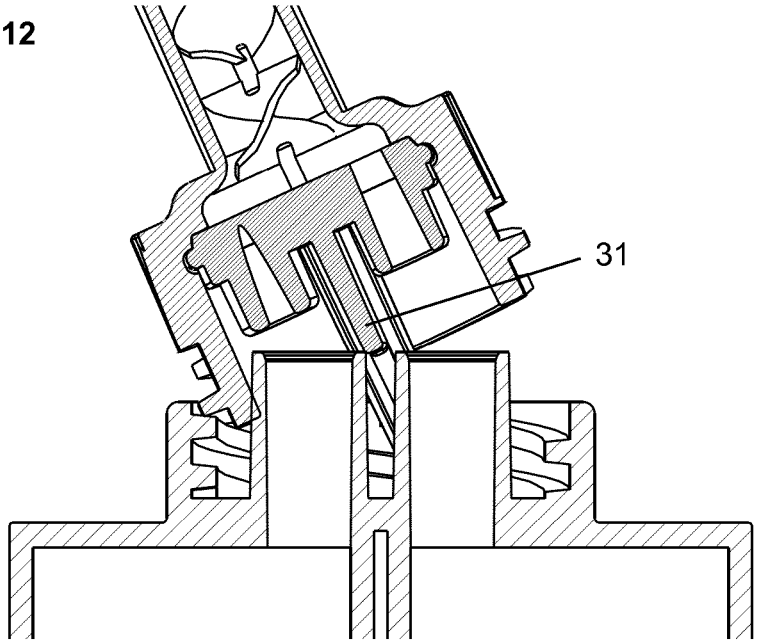
FIG. 12 shows a cross section of a cartridge system according to the invention.

FIG. 12 shows a lateral view of a mixer and a cartridge system according to the invention, whereby it illustrates the case in which a user attempts to position the mixer incorrectly (tilted) on the cartridge. An important feature of the system according to the invention is the avoidance of an unwanted carryover of catalytic component and base component to the respectively other paste component, which could lead to their contamination. This could occur by an unintentional insertion of the guide protrusion first into one and then the other channel, or by touching the inlet and outlet channels of the cartridge and the mixer during an awkward, tilted positioning in the wrong position or analogously, in a tilted reinsertion of a locking stopper.

These unfavorable constellations are avoided as the result of the interaction and the geometric design and configuration of guide protrusion, threads and separating wall 31, as is shown in FIG. 12. Hereby, the guide protrusion at the mixer (or at the locking stopper) is designed in such a way according to the invention, that it cannot be inserted into the outlet channels. Further separating wall 31 is dimensioned in such a way that it only permits small tilting angles between the outlet channels of the cartridge. At the outlet channels of the cartridge, contours can be applied, if desired, which further limit the play for separating wall 31 that is used with respect to unfavorable tilting angles. A locking stopper can additionally have a sleeve-shaped collar (at the position where the thread is located on the mixer), and thus also avoid unfavorable tilting angles.

REFERENCE NUMBERS

1*a*, 1*b* Cartridge
2, 3 Container
4 Connection section
5, 6 Outlet opening or outlet connector
7 Plate
8 Ring
9 Inner thread
10*a*, 10*b* Opening
11*a*, 11*b*, 11*c* Mixer
12 Outer thread
13*a*, 13*b*, 13*c* Guide protrusion
14 Tappet
15 Counter tappet
20*a*, 20*b* Mixer
21*a*, 21*b* Cartridge
22 Opening
23 Guide protrusion
24, 25 Inlet connector
26 Locking stopper
27 Connector
28 Catch element
29 Torsion element
30 Bar
100 Plunger
101 Base body
102 Vent
103 Locking element
104 Protrusion
105 Groove
106 Ventilation slot

What is claimed is:

1. A system consisting of several different types of cartridges and several different types of mixers that can be connected with one another, whereby the cartridges as double cartridges have two containers that are connected with each other having an outlet opening or an outlet connector respectively, and the several different types of mixers respectively have two inlet openings or inlet connectors that can be coupled to the outlet openings or outlet connectors of the cartridges, wherein a size of the inlet openings or inlet connectors for each mixer type and the size of the outlet openings or outlet connectors for each type of cartridge is the same, and that for associating at least one type of mixer with at least one type of cartridge, each said type of mixer is equipped with a cross section that is different than that of the other types of mixers of the system, that a guide protrusion extends in axial direction of each of said mixers, and wherein each type of cartridge is equipped with an opening that is different in cross section from the other types of cartridges of the system for accepting a guide protrusion of a mixer of each of said mixers wherein for attaching said each type of mixer to said each type of cartridge, each type of cartridge is provided with an inner thread and said each type of mixer with an outer thread, whereby the outer thread of said each type of can be screwed into the respective inner thread of said each type of cartridge.

2. A system as recited in claim 1, wherein said each type of cartridge can only be connected precisely with one type of said mixers, and/or said each type of mixers can only be connected with precisely said one type of said cartridge.

3. A system as recited in claim 1, wherein at least one container of one type of said cartridges comprises a volume ratio that is different than 1:1 has, in at least one outlet opening or at least one outlet connector, an element that reduces a lumen.

4. A system as recited in claim 1, wherein the guide protrusions of the mixers and/or the openings of the cartridges are ring-segment-shaped or polygonal in cross section.

5. A system as recited in claim 1, wherein the guide protrusions of different types of said mixers and/or the openings of different types of said cartridges have different protrusions and/or recesses in cross section.

6. A system as recited in claim 1, wherein the different types of said mixers have at least one dynamic mixer with a mixing element that can be driven to rotate and/or at least one static mixer with a non-drivable mixing element.

7. A system as recited in claim 1, wherein the mixers respectively have a mixing area, and that at least two types of said mixers of the system are different in such a way that the diameters of a mixing chamber of the mixers of the system, a length of the mixing chamber of the mixers of the system are different.

8. A system as recited in claim 1, wherein the guide protrusions of the mixers are at a distance from the inlet openings or inlet connectors and located at a distance from the outer thread and the guide protrusions are longer than the inlet openings or inlet connectors.

9. A system as recited in claim 1, wherein at the mixers and at the cartridges catch elements are provided respectively that engage detachable when the outer thread of said mixer is completely screwed into the inner thread of said cartridge.

10. A system as recited in claim 1, wherein at least two types of said cartridges of the system are different in such a way that the ratio of a volume of the two containers is different.

11. A system as recited in claim 1, wherein a separating wall is provided between the inlet openings or inlet connectors of said mixer.

12. A system as recited in claim 11, wherein the separating wall and the guide protrusion of said mixer protrudes over the inlet openings or inlet connectors in axial direction, whereby the guide protrusion is provided with a coding.

13. A system as recited in claim 1, wherein the outlet openings or outlet connectors of the cartridges can be locked with a removable locking stopper.

14. A system as recited in claim 13, wherein the outlet openings or outlet connectors of said cartridges can respectively be locked with identical locking stoppers.

15. A system as recited in claim 13, wherein the locking stopper has two insertable connectors that can be inserted into the outlet openings or outlet connectors of the cartridges, and at least one catch element that can snap onto the cartridges, which is connected with the connectors by a torsion element that can be overcome elastically in such a way that said connectors are elastically rotatable relative to the at least one catch element.

16. A system as recited in claim 1, wherein the mixers respectively have a mixing area, and that at least two types of said mixers of the system are different in such a way that the diameters of a mixing chamber of the mixers of the system, a length of a mixing chamber of the mixers of the system are different.

17. A system as recited in claim 1, wherein the mixers respectively have a mixing area, and that at least two types of said mixers of the system are different in such a way that a length of a mixing chamber of the mixers of the system are different.

18. A system as recited in claim 1, wherein the mixers respectively have a mixing area, and that at least two types of said mixers of the system are different in such a way that a geometry of the mixing element of the mixers of the system are different.

19. A system as recited in claim 1, wherein the mixers respectively have a mixing area, and that at least two types of said mixers of the system are different in such a way that a number of the mixing element of the mixers of the system are different.

* * * * *